US005187835A

United States Patent [19]

Lee

[11] Patent Number: 5,187,835

[45] Date of Patent: Feb. 23, 1993

[54] DOOR CLOSER WITH RACK AND PINION, SPRING, AND SPRING MOUNTING PLATE

[75] Inventor: Sang U. Lee, Seoul, Rep. of Korea

[73] Assignee: Dong Kwang Corporation, Seoul, Rep. of Korea

[21] Appl. No.: 705,546

[22] Filed: May 24, 1991

[30] Foreign Application Priority Data

Jul. 31, 1990 [KR] Rep. of Korea ..... 11361/90

[51] Int. Cl.[5] ..... E05F 3/10

[52] U.S. Cl. ..... 16/52; 16/59; 16/58

[58] Field of Search ..... 16/51, 52, 49, 53, 59, 16/58, 57, 61, 62

[56] References Cited

U.S. PATENT DOCUMENTS

| | | | |
|---|---|---|---|
| 713,267 | 11/1902 | Wolf . | |
| 1,595,171 | 10/1924 | Shonnard . | |
| 1,595,723 | 8/1926 | Norton . | |
| 3,446,317 | 5/1969 | Gryglas | 16/51 |
| 3,618,160 | 11/1971 | Ellis . | |
| 4,048,694 | 9/1977 | Newman et al. . | |
| 4,050,114 | 9/1977 | Zunkel | 16/51 |
| 4,073,033 | 2/1978 | Lexnas . | |
| 4,097,956 | 7/1978 | Kitutaka . | |
| 4,115,847 | 9/1978 | Zunkel | 16/51 |
| 4,234,996 | 11/1980 | Jentsch . | |
| 4,378,612 | 4/1983 | Beers . | |
| 4,386,446 | 6/1973 | Zunkel et al. . | |
| 4,502,180 | 3/1985 | Harrison et al. | 16/58 |
| 4,660,250 | 4/1987 | Tillman et al. . | |
| 4,847,946 | 7/1989 | Nam et al. . | |

FOREIGN PATENT DOCUMENTS 500834 2/1939 United Kingdom .

*Primary Examiner*—Lowell A. Larson
*Assistant Examiner*—Michael J. McKeon
*Attorney, Agent, or Firm*—Omri M. Behr; Matthew J. McDonald

[57] ABSTRACT

A door closer includes a body having a closed, fluid-filled cylinder. A piston is slidably mounted in the cylinder and has an actuating rod with rack gearing. A pinion is rotatably mounted on the body for meshing with the rack gearing of the actuating rod to axially move the piston. The closer also has a valve that can bypass fluid past the piston to regulate its motion. A spring mounted outside the cylinder can apply a balanced, substantially axial force to the actuating rod for axially urging the piston.

18 Claims, 5 Drawing Sheets

DOOR CLOSER WITH RACK AND PINION, SPRING, AND SPRING MOUNTING PLATE

BACKGROUND OF THE INVENTION

The present invention relates to a door closer with a piston driven by a rack and pinion.

In a conventional door closer, the piston is moved to one side by the piston rod which simultaneously compresses a spring when the door opens. Such a spring is installed within the piston cylinder. The piston is returned to its original position by the force of the compressed spring, and accordingly, the door is closed.

As illustrated in FIG. 3, the contacting portion b of the last turn, out of all the spring turns having circular section, receives the force from the piston inner face. As shown in FIG. 4, when a force is transferred to the contacting portion b of spring a, the section of the contacting end portion b of spring a pushed by the inside face of the piston, becomes gradually thinner toward the end of the spring, and therefore the thicker section area receives more force than the thinner section portion. The portion surrounding line A—A (FIG. 3) of contacting portion b receives the most force, and accordingly the spring force is applied in an unbalanced, non-axial manner on the piston. Thus, during extended use, a certain friction occurs between cylinder inner wall and a region of the outside wall of the piston, causing wear, eventual leakage, piston wobbling and plugging of a communicating hole by eroded fragments. This situation will finally lead to faulty operation of the conventional door closer.

In U.S. Pat. No. 713,267, an actuator arm 37 axle drives a piston rod. Because the reference does not use a rack and pinion there is a significant moment tending to turn the piston rod about an axis perpendicular to the length of the rod. For this reason, the piston rod must extend through a return spring into a socket to prevent canting of the piston rod. See also U.S. Pat. No. 3,618,160. Other patents disclose either a rack and pinion mechanism, a spring, or both inside of a hydraulic chamber. See U.S. Pat. Nos. 1,595,723; 4,048,694; 4,073,033; 4,097,956; 4,234,996; 4,378,612; 4,660,250; and 4,847,946.

SUMMARY OF THE INVENTION

In accordance with the illustrative embodiments demonstrating features and advantages of the present invention, there is provided a door closer including a body having a closed, fluid-filled cylinder. The closer has a piston slidably mounted in the cylinder and has an actuating rod with rack gearing. Also included is a pinion rotatably mounted on the body for meshing with the rack gearing of the actuating rod to axially move the piston. A valve means can bypass fluid past the piston to regulate its motion. The closer also has a spring mounted outside the cylinder for applying a balanced, substantially axial force to the actuating rod for axially urging the piston.

The present device improves upon the prior art as follows. The piston operating in a cylinder is moved by an actuating rod and preferably a spring operating chamber is installed on one side of the main body such that the actuation rod is moved by the spring in the separate spring operating chamber. Therefore the piston connected to the actuating rod operates without any tilting motion and therefore the actuation becomes accurate and remains accurate during extended use. Also, any wear between cylinder and piston is eliminated, such that no harmful fragments are formed to plug the communicating holes. Also, the main cylinder size can be smaller due to the separate spring actuating chamber, so that the amount of oil required is smaller which contributes to reduced fire hazard.

BRIEF DESCRIPTION OF THE DRAWINGS

The above brief description as well as other objects, features and advantages of the present invention will be more fully appreciated by reference to the following detailed description of presently preferred, but nonetheless illustrative embodiments in accordance with the present invention when taken in conjunction with the accompanying drawings wherein.

DESCRIPTION OF THE PREFERRED EMBODIMENT

Figure 1:
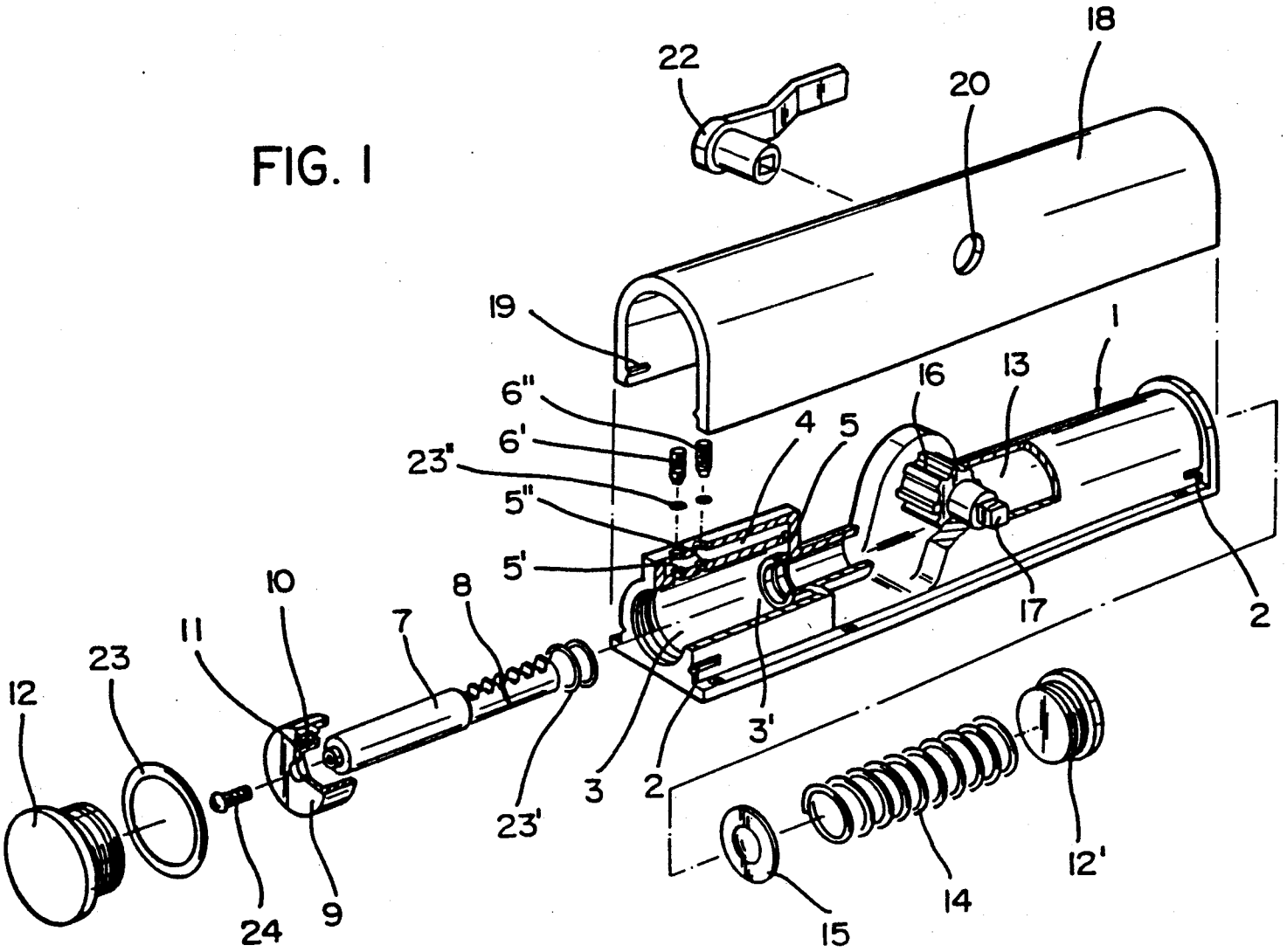
FIG. 1 is an exploded view of the present device.

Referring to FIGS. 1 and 2A-2F, piston 9 is fixed on actuating rod 7 by a bolt 24 and inserted in the oil-filled cylinder 3, 3' formed in body 1. Cylinder 3' is sealed to rod 7 by two annular gaskets 23' mounted in grooves in body 1. Plug 12 is screwed on one end of cylinder 3 with gasket 23. In order to provide communication between both sides of cylinder 3, 3', separated by piston 9, a communicating hole 11 is made in one side of piston 9, and at the same time a check valve 10 is installed, shown as a spring and ball. Also, on the other side of actuating rod 7, rack gearing 8 is provided in order to engage with pinion 16 mounted to rotate with pinion shaft 17.

A conduit 4 acting as a flow path is provided on cylinder 3' in order to communicate with orifice 5, and distally from it, orifices (sometimes referred to as apertures) 5', 5''. Orifices 5', 5'' are provided in one side of flow path 4 such that they are able to be opened and closed by valves, shown here as regulating bolts 6, 6', sealed by gaskets 23''. Bolts 6, 6' and check valve 10 are sometimes referred to as a valve means.

Also, at the other side of the main body 1, spring operating chamber 13 is installed, and spring 14 is supported by spring support plate 15 and inserted in the chamber 13. Plate 15 has a central depression that axially drives the end of rod 7. Common plug 12' is screwed on the outer end of chamber 13. Concave grooves 2 are provided on each side of main body 1 in order for the tongues 19 of the cover 18 to be engaged. Cover 18 has a hole through which crank 22 is inserted to connect with pinion shaft 17.

In the present device, piston 9, reciprocates, by the operation of actuating rod 7 and spring 14, inside the cylinder 3, 3' of the main body 1, such that when the door (not shown) opens, the pinion 16 is rotated by the rotation of pinion shaft 17. In response, actuating rod 7 is moved to one end and the piston 9 is also moved in the same direction due to the engagement of the rack gear 8 of the actuating rod 7 and pinion 16. When the door is closed, actuating rod 7 is returned to its original position by the expanding force of spring 14 and the piston 9 is also returned.

Figure 2A:
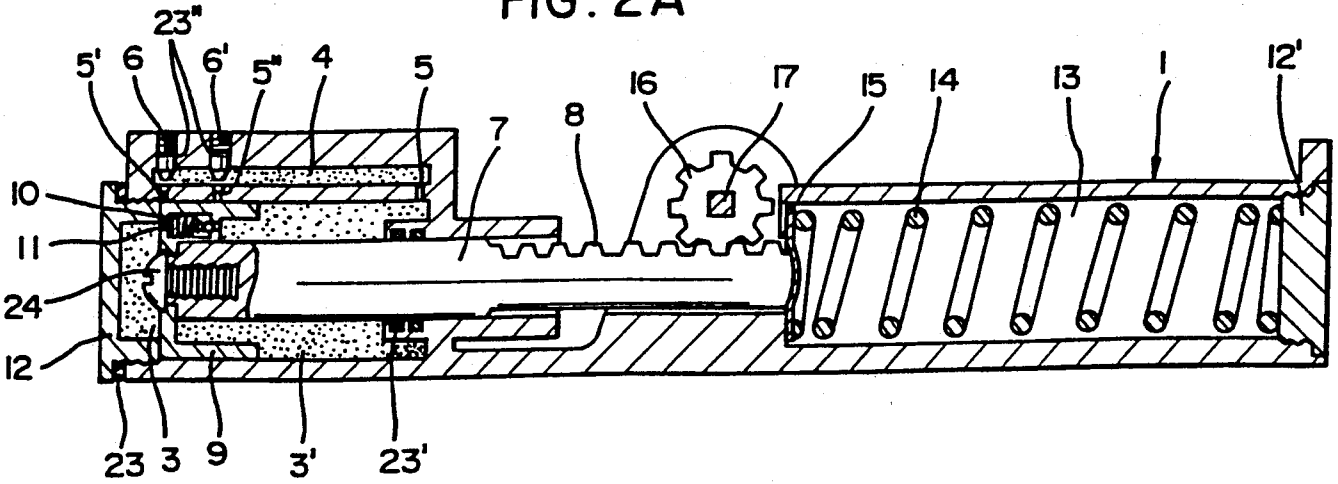
FIGS. 2A through 2F are sectional views illustrating operation of the present device.
Figure 2B:
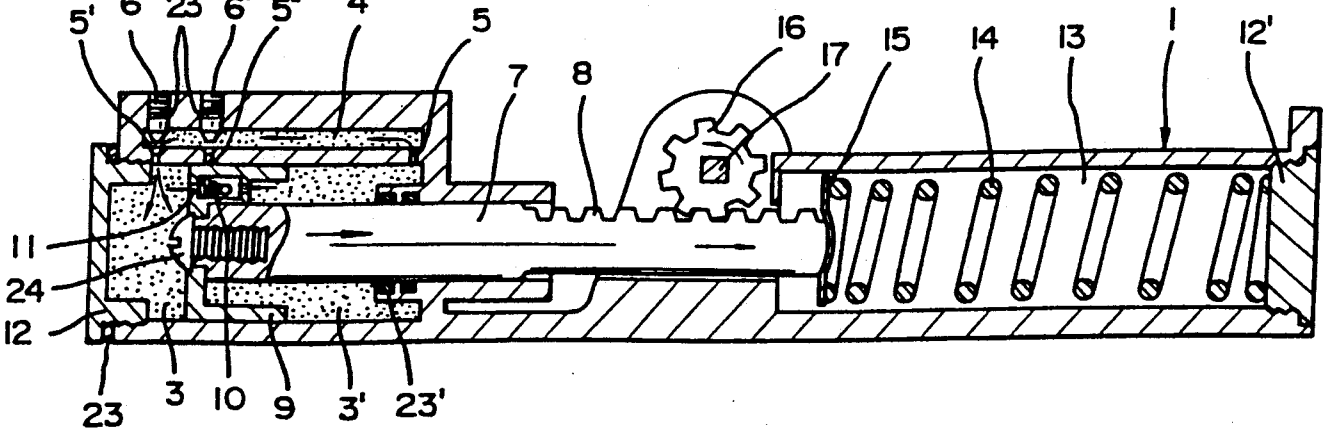
Figure 2C:
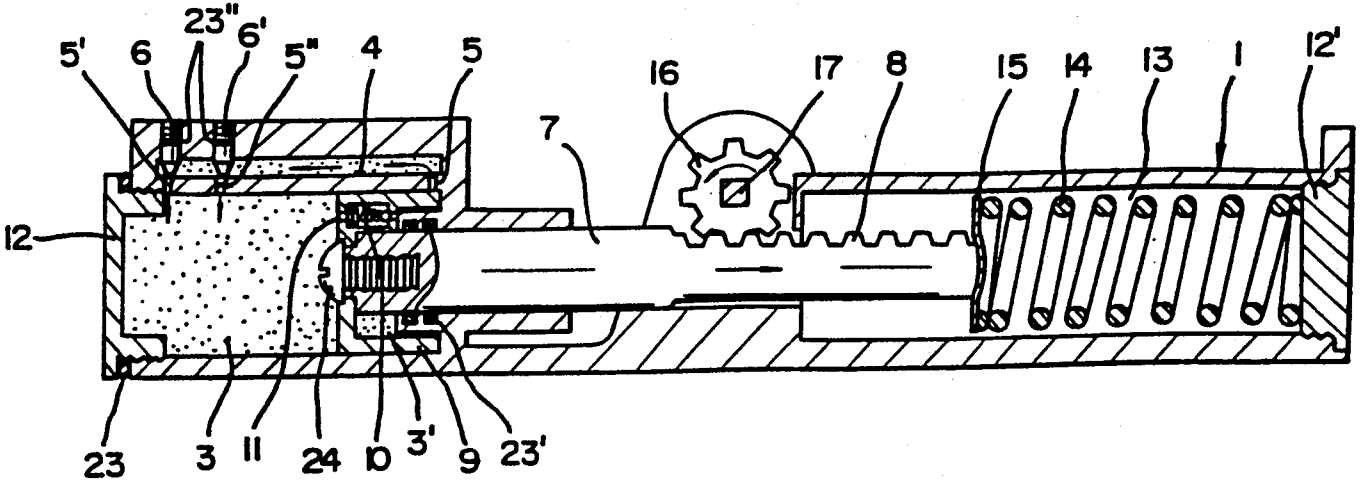

When the door opens, pinion 16 is rotated by pinion shaft 17 which moves the rack gear 8 of the actuating rod 7 to other side as shown in FIG. 2B. Then piston 9, installed on actuating rod 7 inside of cylinder 3, 3', is moved within cylinder 3'. Thus the oil flows simultaneously through cylinder 3, through check valve 10 in communicating hole 11 inside piston 9, and through flow path 4.

Here, when the door just begins to open, the oil flows only through check valve 10 of communicating hole 11 because orifices 5' and 5" are blocked. Thus the effective bypass is consequently reduced and therefore the piston receives resistance in the course of moving within cylinder 3' and some force is required initially to open the door. As further opening proceeds, the movement of piston 9 proceeds further, and through holes 5', 5" open successively causing larger amounts of oil to flow, and therefore, less force is needed to open the door wider.

Thus, by the opening action of the door, the other end of actuating rod 7 pushes the spring support plate 15 supported by spring 14 in the spring operating chamber causing compression of spring 14. As a consequence, when the door is left open, the spring support plate 15 is returned to its original position by the force of spring 14 and the actuating rod 7 is returned to cylinder 3.

Figure 2D:
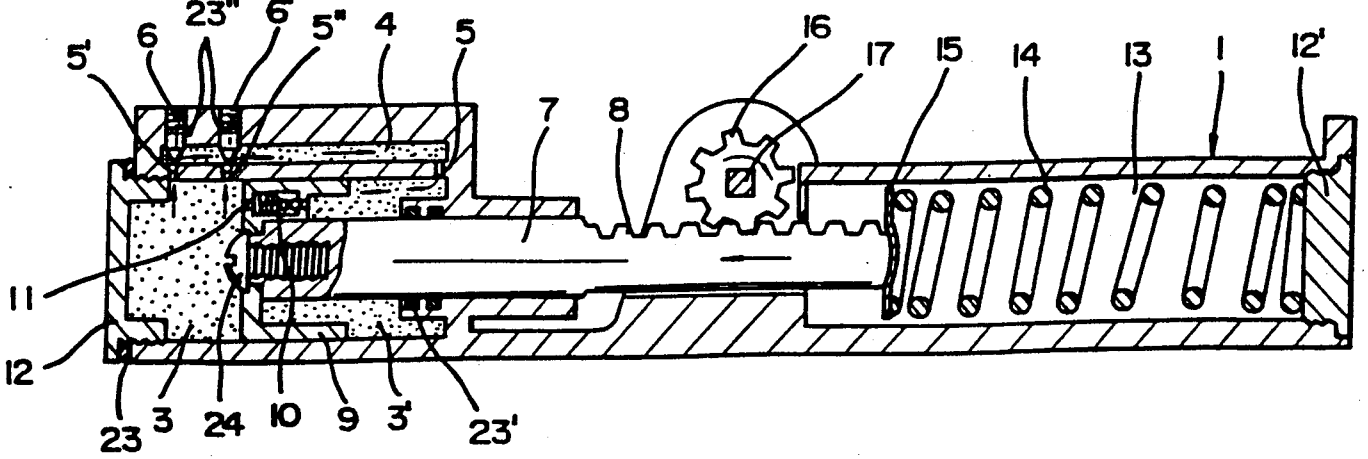
Figure 2E:
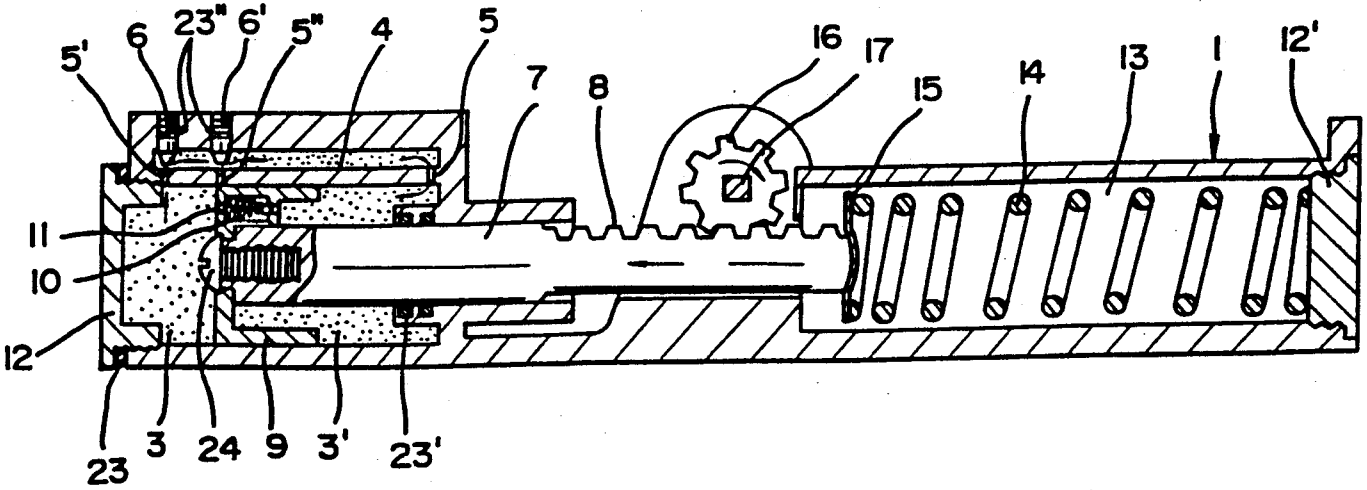
Figure 2F:
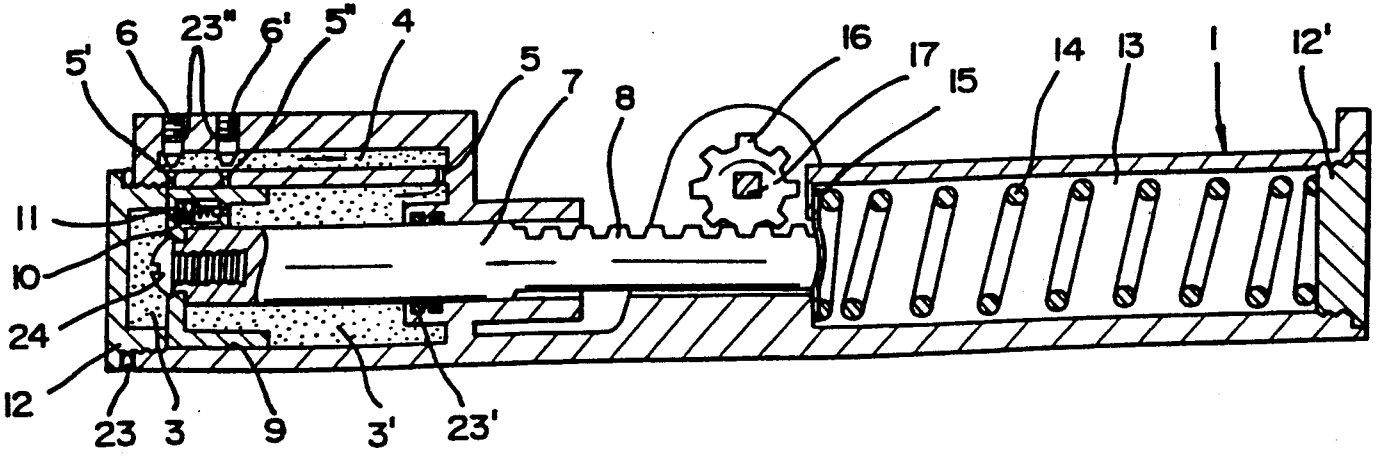
Figure 3:
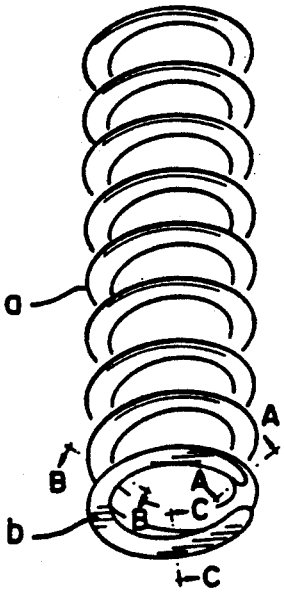
FIG. 3 is a perspective view of a conventional spring.
Figure 4A:
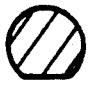
FIGS. 4A, 4B and 4C are sectional views through lines A—A, B—B and C—C of FIG. 3 of the present device.
Figure 4B:
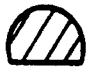
Figure 4C:
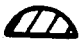

As shown in FIG. 2D, at the moment of moving of piston 9 toward cylinder 3, check valve 10 becomes closed by oil, and the oil of cylinder 3' passes through flow path 4 via through holes 5', 5". When piston 9 moves continuously through cylinder 3 by the force of spring 14 to a position representing 70 to 75 degrees before closing of the door, through hole 5" closes thereafter. Then the oil flows from cylinder 3' only via through hole 5', and therefore the flow speed of oil becomes slow, and also resistance occurs by the oil causing slow speed of piston movement. Consequently pinion shaft 17 rotates slowly as the actuating rod 7 moves slowly. Finally the door closes slowly for the final 15 to 20 degree position before full closing of the door.

The regulating bolts 6, 6' screwed above the through holes 5', 5" in flow path 4 regulate the amount of oil flowing in accordance with the degree of opening and closing of through holes 5', 5". The through holes also regulate the moving speed of piston 9 so that the closing speed of door can be regulated.

By means of separately installing cylinders 3, 3'with an operating piston 9, and the spring operating chamber 13 actuating the actuating rod 7, and also by transferring to the actuating rod 7 the force exerted from position 9 when the door opens and the force exerted from spring 14 when the door closes and also by concentrating the force transferred to the actuating rod 7 on the central portion of piston 9 operating inside of cylinder 3, 3', the operational accuracy of piston 9 can be improved and used for a long time. Also, little or no wear occurs between cylinder 3, 3' and piston 9, and no fragments are formed so that through holes 5, 5', 5"are never clogged. And by separating the spring operating chamber 13, by making cylinder 3, 3' small, and accordingly by lessening the amount of oil, any probable fire hazards are diminished. A cover 18 over the main body 1 was installed for a better appearance.

Throughout the operating cycle, the rack gearing 8 and the spring 14 are kept outside of the chambers 3 and 3'. Thus any chips or fragments produced by these moving parts will not clog any of the apertures or orifices in the chambers. Furthermore, spring 14 works through support plate 15 to apply a balanced force axially along rod 7. Since plate 15 has a central spherical depression, any imbalances due to the spring are accommodated by tilting of the plate 15. Thus, there is no tendency for piston 9 to cock due to the spring 15 or any of the other mechanisms illustrated herein.

It is to be appreciated that various modifications may implemented with respect to the above described preferred embodiments. The valving can be accomplished by a separate pipe having a valve of any convenient type. Furthermore, in some embodiments, a check valve may be used in a position other then on the piston. In addition, the shape of the actuating rod can be rectangular, square, triangular or have other compound shapes. In some embodiments, the piston rod can be urged to its neutral position by springs other than a helical compression spring. While a conduit with a trio of orifices and aperture are shown for bypassing the piston, in some embodiments, a greater or fewer number can be used. Additionally, the spring can be kept in a housing that may be open. Furthermore, the fluid employed around the piston can be a liquid, a gas or any other medium suitable for regulating the motion of the piston. Also, the pitch of the rack and pinion can be altered depending upon the forces involved, the desired smoothness of operation, etc. Moreover, the size, shape and dimensions of the door closer can be altered depending upon the desired strength, degree of motion, expected forces, etc. Also, the door closer can be made out of various materials including steel, ceramics, plastics and other materials suitable for the purposes intended.

Obviously many modifications and variations of the present inventions are possible in light of the above teachings. It is therefore to be understood that within the scope of the appended claims, the invention may be practiced otherwise than as specifically described.

I claim:

1. A door closer comprising:

a body having a closed, fluid-filled cylinder;

a piston slidably mounted in said cylinder and having an actuating rod with rack gearing;

a pinion rotatably mounted on said body for meshing with the rack gearing of said actuating rod to axially move said piston, said rack and said pinion being located outside said cylinder;

valve means for bypassing fluid past said piston to regulate its motion, said valve means being located in said cylinder;

a spring mounted outside said cylinder for applying a balanced, substantially axial force to said actuating rod for axially urging said piston, said spring and said actuating rod being mounted end to end; and a support plate mounted between said spring and said actuating rod for transmitting force therebetween, said support plate having a central depression for receiving the end of said actuating rod distal to said cylinder, and for maintaining alignment and accommodating imbalances caused by said spring.

2. A door closer according to claim 1 wherein said support plate has a central depression for receiving the end of said actuating rod distal to said cylinder.

3. A door closer according to claim 1 wherein said valve means comprises:

a check valve mounted in said piston for bypassing fluid past said piston in one direction.

4. A door closer according to claim 3 wherein said valve means comprises:

a conduit in said body for communicating with a pair of axially spaced orifices in said cylinder.

5. A door closer according to claim 4 wherein at least one of said pair of axially spaced orifices includes: an orifice valve means for regulating the flow of fluid through said at least one of said orifices.

6. A door closer according to claim 5 further including stoppable means for at least one of said orifices wherein a stoppable one of said orifices is positioned to be stopped upon said piston overlapping said stoppable means for said stoppable one of said orifices.

7. A door closer according to claim 6 wherein said cylinder has an aperture communicating with said pair of orifices, said stoppable means for said stoppable one of said orifices being between the other one of said orifices and said aperture.

8. A door closer according to claim 7 wherein said valve means comprises:

an aperture valve for controlling fluid flow in said aperture.

9. A door closer according to claim 8 comprising:

a cover attached to said body by a tongue and groove joint.

10. A door closer according to claim 1 wherein said valve means comprises:

a check valve mounted in said piston for bypassing fluid past said piston in one direction

11. A door closer according to claim 10 wherein said valve means comprises:

a conduit in said body for communicating with a pair of axially spaced orifices in said cylinder.

12. A door closer according to claim 11 wherein at least one of said orifices includes:

an orifice valve for regulating the flow of fluid through one of said orifices.

13. A door closer according to claim 12 comprising:

a support plate mounted between said spring and said actuating rod.

14. A door closer according to claim 13 wherein said stoppable means for a stoppable one of said orifices is positioned to be stopped upon said piston overlapping said stoppable means for said stoppable one of said orifices.

15. A door closer according to claim 14 wherein said cylinder has an aperture communicating with said pair of orifices, said stoppable means for said stoppable one of said orifices being between the other one of said orifices and said aperture.

16. A door closer according to claim 15 wherein said valve means comprises:

an aperture valve for controlling fluid flow in said aperture.

17. A door closer according to claim 16 comprising:

a cover attached to said body by a tongue and groove joint.

18. An arrangement comprising:

a body having a cylinder closed on one end by a threaded plug;

a piston having an actuating rod bolted to the piston and inserted into the cylinder, the piston having a communicating hole provided on one side of the piston in order for the cylinder divided into two sides by the piston to communicate with each other;

a check valve provided in the communicating hole of the piston, said check valve located in said cylinder;

a pinion having a pinion shaft rotatably mounted on the body; and a rack gear formed on one end of the rod distal to the piston in order to engage with the pinion rotated by the pinion shaft, said rack and pinion located outside said cylinder, the body also having:

a flow path having a pair of through holes formed on the upper part of the cylinder in order to be communicable with a third hole;

a pair of regulating bolts, the through holes being provided in one end of the flow path in order to be able to be opened and closed by the regulating bolts;

a spring chamber formed at the end of the body opposite the cylinder and having a spring and spring support plate, said support plate being interposed between said spring and said actuating rod, said support plate having a central depression for receiving the end of said actuating rod distal to said cylinder for maintaining alignment and accommodating imbalances caused by said spring;

a plug screwed on one end of the spring chamber;

a cover having convex ridges; and a pair of concave notches formed on opposite sides of the body in order for the convex ridges of cover to be engaged.

* * * * *